US007794369B1

(12) United States Patent
Rivera, III

(10) Patent No.: US 7,794,369 B1
(45) Date of Patent: Sep. 14, 2010

(54) JUMP ROPE WITH RESISTANCE HAND GRIPS

(76) Inventor: Nicholas Rivera, III, 645 Water St., Apt 5A, New York, NY (US) 10002

( * ) Notice: Subject to any disclaimer, the term of this patent is extended or adjusted under 35 U.S.C. 154(b) by 22 days.

(21) Appl. No.: 12/313,948

(22) Filed: Nov. 26, 2008

(51) Int. Cl.
*A63B 21/00* (2006.01)

(52) U.S. Cl. ..... 482/81; 482/82

(58) Field of Classification Search ..... 482/127, 482/49, 80–82
See application file for complete search history.

(56) References Cited

U.S. PATENT DOCUMENTS 1,436,703 A 11/1922 Fisher
2,848,234 A * 8/1958 Brandon ..... 473/229
3,415,515 A 12/1968 Otto
4,093,211 A * 6/1978 Hughes et al. ..... 482/49
D264,737 S 6/1982 Cooper
4,572,503 A * 2/1986 Myung Ho ..... 482/82
D358,857 S 5/1995 Yang
5,842,956 A 12/1998 Strachan
D418,561 S 1/2000 Cousins
6,786,849 B1 9/2004 Faulconer

* cited by examiner

*Primary Examiner*—Jerome Donnelly
(74) *Attorney, Agent, or Firm*—Montgomery Patent and Design; Robert C. Montgomery; Joseph T. Yaksich

(57) ABSTRACT

An exercise device which combines the functionality of a jump rope with that of a pair of spring-operated hand-grips is herein disclosed. The device comprises two (2) conventional spring-loaded hand grips at distal ends of the rope. The rope is attached to the top of the hand grips using a ball bearing-type swivel joint that allows the rope to turn freely, even while the hand grips are held stationary. It is envisioned that the grips could be flexed while using said exercise device, held in a closed position for resistance training while jumping rope or used alone without utilizing the jump rope.

12 Claims, 3 Drawing Sheets

JUMP ROPE WITH RESISTANCE HAND GRIPS

RELATED APPLICATIONS

The present invention was first described in official Record of Invention filed on Aug. 20, 2007 and incorporated by reference thereto in this application as if set forth fully herein.

FIELD OF THE INVENTION

The invention, as presently disclosed, relates generally to a jump rope exercising device and, more specifically, to a jump rope comprising attached resistance hand grips that combines the functionality of a jump rope with that of a pair of spring-operated handgrips each comprising a swivel joint that allows the rope to turn freely, even while the hand grips are held stationary.

BACKGROUND OF THE INVENTION

One favorite tool of many who exercise is the jump rope. Jumping rope is a high impact, high aerobic activity that develops cardiovascular and muscular endurance along with agility, coordination, and muscular strength. It can be done virtually anywhere and with minimal equipment costs. Another low cost, but common, piece of exercise equipment is that of the hand grip spring exerciser. Such a device allows one to strengthen hand muscles by simply moving them back and forth in a repeating fashion. However, as useful as these two (2) devices are, they must be used separately and not together. This obviously lengthens workout sessions and takes away time from other beneficial routines. Accordingly, there is a need for means by which the health benefits associated with jumping rope and using a spring hand grip can be realized while performing a single exercise routine. The development of the exercise device herein described fulfills this need.

Probably the largest obstacle to many Americans that wish to get into shape is the lack of time to exercise. Accordingly, exercise devices that minimize the amount of time necessary to exercise or that can exercise a user more efficiently are prized commodities. An exercise device that combines the benefits of arm and wrist conditioning with a cardiovascular work-out would save time for a user. The device herein described would be of benefit to many types of users, such as boxers, athletes and the regular person who is seeking a quality work-out.

Several attempts have been made in the past to provide exercising devices. U.S. Pat. No. 6,786,849 issued to Faulconer discloses an adjustable hand grip exerciser that comprises a resistance elastomeric member mounted on a pair of pivot elements. Unfortunately, this patent does not appear to disclose a pair of resistance hand grip assemblies mounted to a jump rope using a swivel assembly.

U.S. Pat. No. D 418,561 issued to Cousins discloses a handgrip exerciser that appears to be a pair of handle grips attached to a circular housing. Unfortunately, this design patent does not appear to be similar to the disclosed device herein nor does it appear to possess attachment means to a jump rope.

U.S. Pat. No. 5,842,956 issued to Strachan discloses a strength resistance training jump rope that appears to be a continuous loop of jump rope with two (2) slidable handles. Unfortunately, this patent does not appear to disclose two (2) resistance handle grips attached by means of a swivel mechanism to a jump rope.

U.S. Pat. Nos. D 358,857 issued to Yang and D 264,737 issued to Cooper disclose hand grip type exercisers with differing handles. Unfortunately, these design patents do not appear to disclose devices that appear to be similar to the disclosed device, nor do the disclosed patents appear to disclose two (2) resistance hand grips attached to a jump rope by means of a swivel assembly.

U.S. Pat. No. 3,415,515 issued to Otto discloses a rubber cord skipping rope and exerciser that appears to be a rubber jumping rope with integral handles attached upon the ends for gripping. Unfortunately, the disclosed patent does not appear to disclose a jump rope with a pair of resistance hand grips located on both ends.

U.S. Pat. No. 1,436,703 issued to Fisher discloses a jumping rope with a pair of handles. Unfortunately, this patent does not appear to disclose a jumping rope with a pair of resistance hand grip assemblies attached by means of a swivel assembly to permit the grip assemblies to remain stationary while the jump rope is utilized.

None of the prior art particularly describes a jumping rope with attached resistance hand grips that combines the functionality of a jump rope with that of a pair of spring-operated hand-grips each comprising a ball bearing-type swivel joint that allows the rope to turn freely, even while the hand grips are held stationary that the instant device possesses. Accordingly, there exists a need for a means by which the health benefits associated with jump rope and using a spring hand grip can be realized while performing a single exercise routine that operates without the disadvantages as described above.

SUMMARY OF THE INVENTION

In view of the foregoing disadvantages inherent in the prior art, it has been observed that there is need for a device and method for a jump rope with resistance hand grips which combines the functionality of a jump rope with that of a pair of spring-operated hand-grips.

An object of the jump rope with resistance hand grips comprises a jump rope attached to resistance hand grip assemblies with a ball bearing-type swivel joint that allows the jump rope to turn freely as the hand grips are held stationary.

Another object of the jump rope with resistance hand grips provides coincidental arm strengthening and cardio-vascular physical fitness workouts by utilizing a resistance grip assembly and a conventional jump rope.

A further object of the jumping rope with resistance hand grips provides for flexing the grip assemblies to a closed position while jumping rope or alternately flexed without utilizing the jump rope, thereby providing an exercising means.

Still another object of the jump rope with resistance hand grips comprises hand grip assemblies molded to conform to a user's hand profile to provide a comfortable gripping means while using the invention.

Still a further object of the jump rope with resistance hand grips provides for a grip assembly with a finger grip portion comprising four (4) finger relief areas along an outer edge positioned to correspond to a user's fingers for additional comfort.

Yet another object of the jump rope with resistance hand grips may provide an enhanced gripping surface utilizing methods such as, but not limited to: a molded-in knurled pattern thereupon external surfaces, a sprayed-on latex coating.

Yet still another object of the jump rope with resistance hand grips comprises a jump rope is envisioned to be introduced in a range of lengths approximately six (6) to nine (9) feet long corresponding to users having various heights and skill levels.

Still another object of the jump rope with resistance hand grips is a jump rope envisioned to be made of leather; however, other suitable materials and jump rope types may be provided such as, but not limited to: polyvinylchloride (PVC), braded nylon cord, beaded ropes, weighted ropes.

Yet another object of the jump rope with resistance hand grips may be used independently of each other to develop the arms using solely the resistance hand grips or to achieve a work-out using the jump rope without manipulating the attached hand grips.

An aspect of the jump rope with resistance hand grips comprises two (2) spring-loaded hand grip assemblies positioned at the distal ends of a jump rope.

Another aspect of the jump rope with resistance hand grips comprises a grip assembly further comprising a thumb grip portion, a finger grip portion, a spring a retaining ring, support links, a pair of connector plates, a pair of hinges, a swivel bearing assembly, and a jumping rope.

Still another aspect of the jump rope with resistance hand grips comprises a thumb grip portion and a finger grip portion comprising a generally cylindrical-shaped form made using injection molded hard plastic materials, further comprising a particular molded shape and circumference to conform to a user's hand profile to provide a comfortable gripping means. The finger grip comprises four (4) finger relief areas along an outer edge positioned to correspond to a user's fingers, thereby providing an enhanced gripping surface.

A further aspect of the jump rope with resistance hand grips further comprises a torsion spring that extends in an upward direction from the grip portions of the grip assembly to form a two (2) coil spring element and is envisioned to be introduced in a variety of resistance forces based upon a user's strength and skill level.

Another aspect of the spring further comprises a retaining ring which provides a mechanical limiting means thereto said expanding tension, thereby establishing a fixed relative position of the grips when in a relaxed state.

An additional aspect of the jump rope with resistance hand grips comprises a grip portion that provides an attachment means to a jump rope by respective connector plates providing a sliding attachment means thereto the spring via a pair of ring-shaped lateral support links being welded or soldered to said connecting plates at an intermediate location along inner-facing surfaces.

A further aspect of the jump rope with resistance hand grips comprises support links that extend horizontally from the connector plates to provide additional strength and stability to the grip assembly. The support links are envisioned being made using similar materials as the spring.

Yet another aspect of the jump rope with resistance hand grips comprises connector plates that provide an attachment means to the swivel bearing assembly at an upper end portion via a pair of hinges.

Still yet another aspect of the jump rope with resistance hand grips comprises a swivel bearing assembly that provides a rotary attachment to the jump rope allowing the jump rope to freely rotate with respect thereto the grip assemblies and secureably affixed therein preferably using adhesives; however, other durable methods of attachment may be employed such as crimping, a through-pin, or the like, providing equal benefit thereto a user.

A method of and utilizing an exercise device comprising a jump rope with resistance hand grips may be achieved by performing the following steps: procuring a particular model of the exercising device which provides a desired jumping rope length and spring resistance; grasping the two (2) grip assemblies such that a user's fingers are in contact with the finger relief portions of the finger grips; squeezing each thumb and finger grip pair together, thereby enabling the flexing motion of the device and reducing a relative distance between said grips; experiencing a normal rope jumping session in a normal manner; and, enjoying combined benefits of arm strengthening and cardio-vascular workouts afforded a user of the present invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
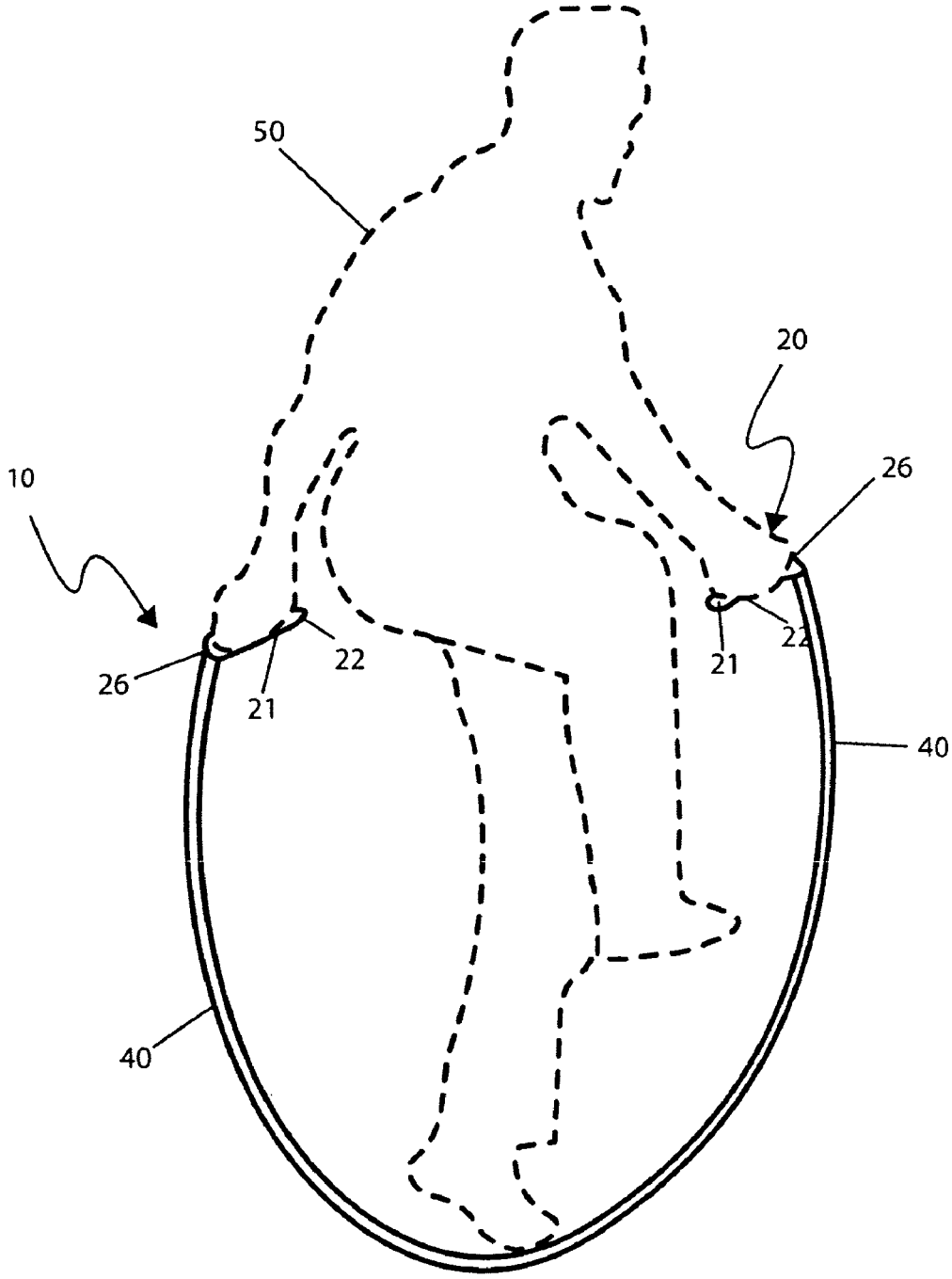
FIG. 1 is an environmental view of a jump rope with resistance hand grips 10, according to a preferred embodiment of the present invention.

10 jump rope with resistance hand grips
20 grip assembly
21 thumb grip
22 finger grip
23 finger relief
24 spring
25 retaining ring
26 connector plate
27 support link
28 hinge
30 swivel bearing assembly
31 outer bearing race
32 inner bearing race
40 jumping rope
45 flexing motion
50 user

DETAILED DESCRIPTION OF THE PREFERRED EMBODIMENT

Figure 2:
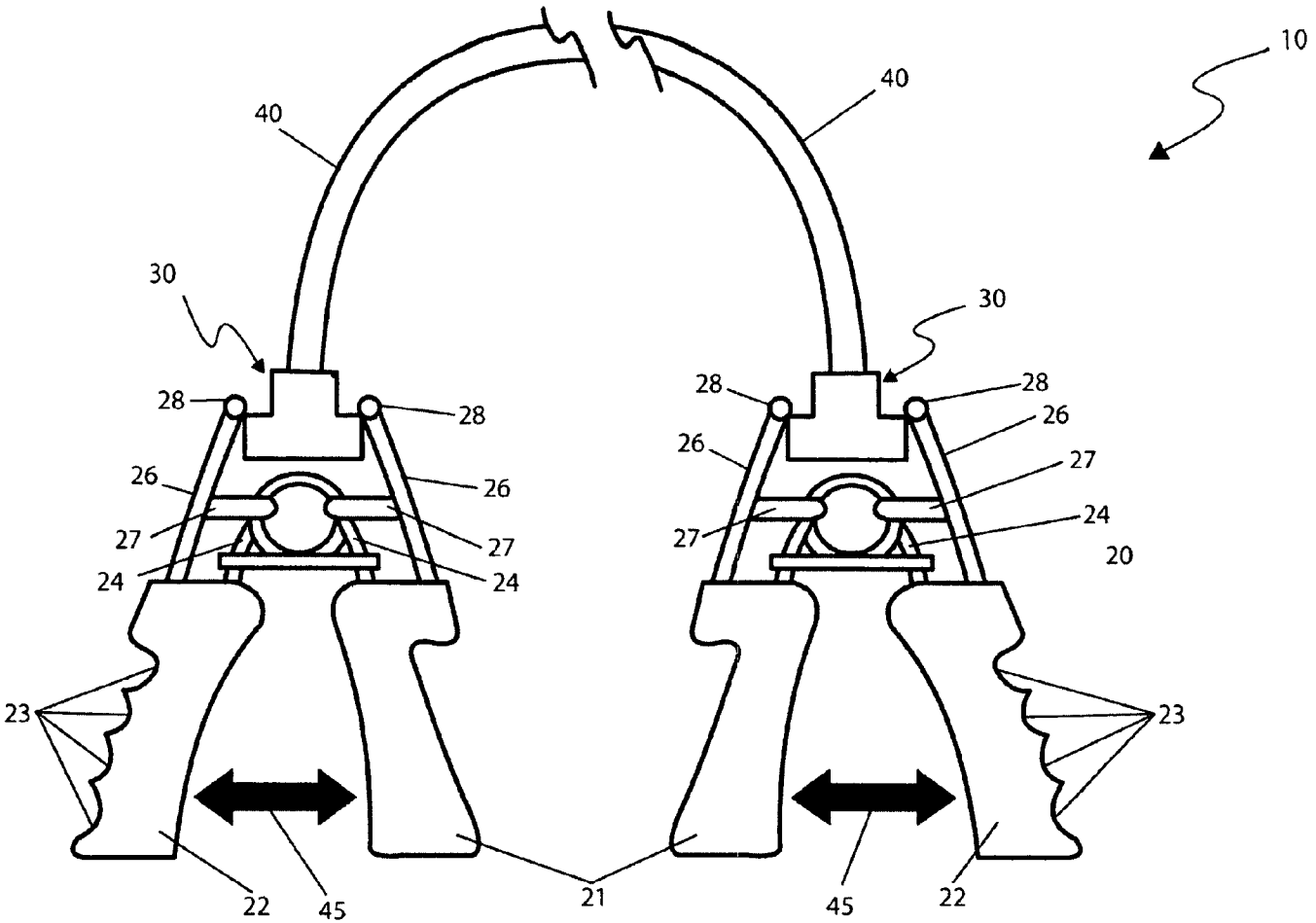
FIG. 2 is a perspective view of a jump rope with resistance hand grips 10, according to a preferred embodiment of the present invention; and, FIG. 3 is a close-up view of a grip assembly portion 20 of a jump rope with resistance hand grips 10, according to a preferred embodiment of the present invention.
Figure 3:
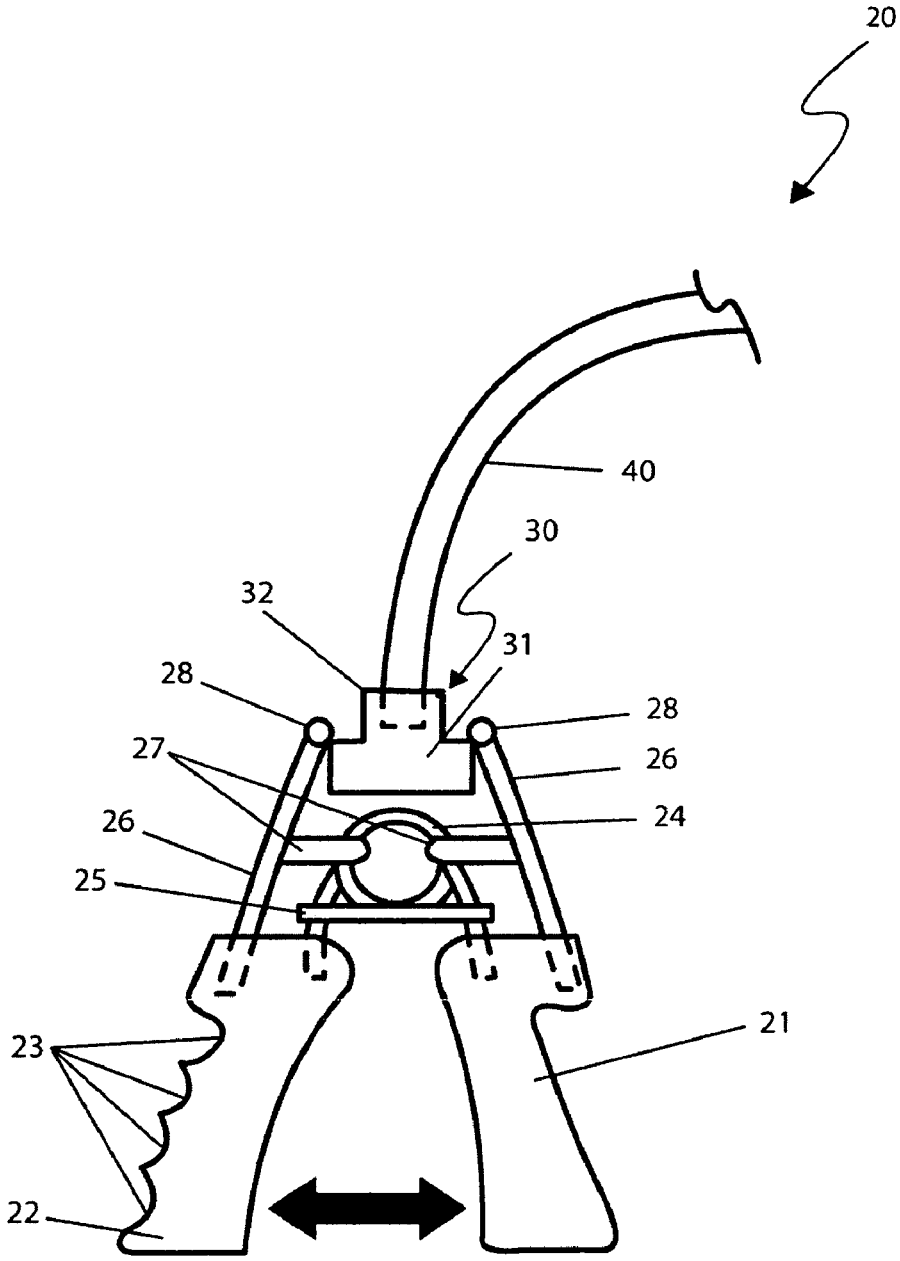

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a jumping rope with resistance hand grips (herein described as the "device") 10, which combines the functionality of a jumping rope 40 with that of a pair of spring-operated hand-grips 20. The device 10 comprises two (2) conventional spring-loaded hand grips 20 at distal ends of a jumping rope 40. The jumping rope 40 is attached along an upper portion of the hand grips 20 thereto a ball bearing-type swivel joint 29 that allows the jumping rope 40 to turn freely as the hand grips 20 are held stationary. It is envisioned that the grips 20 are to be flexed 45 to a closed position while jumping rope or alternately flexed 45 without utilizing the jumping rope 40, thereby providing an exercising means thereto a user 50.

Referring now to FIG. 1, an environmental view of the device 10, according to the preferred embodiment of the present invention, is disclosed. The device 10 comprises a pair of grip assemblies 20 and a jumping rope 40. The device 10 is illustrated here during a rope jumping activity. The device 10 provides coincidental arm strengthening and cardio-vascular physical fitness workouts by utilizing a resistance grip assembly 20 and a conventional jumping rope 40. Each grip assembly 20 comprises a thumb grip 21 and a finger grip 22 taking a form of an inverted "V" being similar to commercially available resistance hand grippers. Each grip portion 21, 22 provides an attachment means thereto a jumping rope 40 via respective connector plates 26 extending in an upward direction therefrom upper surfaces of said grips 21, 22. The jumping rope 40 is envisioned to be introduced in a range of lengths approximately six (6) to nine (9) feet long corresponding thereto users 50 having various heights and skill levels. The jumping rope 40 is also envisioned to be preferably made of leather; however, other suitable materials and jumping rope types may be provided such as, but not limited to: polyvinylchloride (PVC), braded nylon cord, beaded ropes, weighted ropes, or the like, providing equal benefit and versatility to a user 50 and as such should not be considered a limiting factor of the device 10.

Referring now to FIG. 2, a perspective view of the device 10, according to the preferred embodiment of the present invention, is disclosed. Each grip assembly 20 further comprises a thumb grip portion 21 and a finger grip portion 22. Each of the grips 21, 22 comprises a generally cylindrical-shaped form made using injection molded hard plastic materials. The grips 21, 22 comprise a particular molded shape and circumference suitable to a user's 50 hand profile to provide a comfortable gripping means. The finger grip 22 comprises four (4) finger relief areas 23 along an outer edge positioned correspondingly thereto a user's 50 fingers in an expected manner. It is envisioned that the grip portions 21, 22 may provide an enhanced gripping surface utilizing methods such as, but not limited to: a molded-in knurled pattern thereupon external surfaces, a sprayed-on latex coating, or the like. Each grip portion 21, 22 further comprises a horizontally protruding upper portion with a flat upper surface providing an embedded attachment thereto a connector plate 26 and a torsion spring 24 being affixed thereinto each grip 21, 22 during an injection-molding process. The torsion spring 24 extends in an upward direction therefrom the grip portions 21, 22 of the grip assembly 20 to form a two (2) coil spring element. The spring 24 is envisioned being made using tempered and plated spring steel in an expected manner providing a flexible angular relationship providing a flexing motion 45 therebetween attached grips 21, 22 and is envisioned to be introduced in a variety of resistance forces based upon a user's 50 strength and skill level.

Referring now to FIG. 3, a close-up view of a grip assembly portion 20 of the device 10, according to a preferred embodiment of the present invention, is disclosed.

A single grip assembly 20 is illustrated here comprising a spring 24, a retaining ring 25, a pair of connector plates 26, a swivel bearing assembly 30, and a jumping rope 40. The spring 24 is envisioned to provide a static outward expanding tension thereto the grip assembly 20. The spring 24 further comprises a retaining ring 25 which provides a mechanical limiting means thereto said expanding tension, thereby establishing a fixed relative position of the grips 21, 22 when in a relaxed state. The retaining ring 25 comprises an ovular-shaped element with an open center region which encompasses both downwardly extended end portions of the spring 24 adjacent thereto upper grip surfaces 21, 22 and is envisioned being made using similar materials as the spring 24. The two (2) connector plates 26 comprise rectangular-shaped elements approximately one-quarter (¼) to one-half (½) inch wide securely embedded thereinto each grip 21, 22 and extending upwardly at a converging angle thereinto respective hinge portions 28. The connecting plates 28 further provide a sliding attachment means thereto the spring 24 via a pair of ring-shaped lateral support links 27 being welded or soldered thereto said connecting plates 26 at an intermediate location along inner-facing surfaces. The support links 27 extend horizontally therefrom the connector plates 26 slidingly looping therearound side coiled portions of the spring 24, thereby providing additional strength and stability thereto the grip assembly 20. The support links 27 are envisioned being made using similar materials as the spring 24. The connector plates 26 provide an attachment means thereto the swivel bearing assembly 30 at an upper end portion via a pair of hinges 28. The hinges 28 comprise a common metal fixture providing a horizontal axle and a plurality of captivating apertures in an expected manner providing a pivoting relative motion therebetween the connector plate 26 and the swivel bearing assembly 30. The hinges 28 are envisioned being ruggedly affixed thereto said connector plates 26 and the swivel bearing assembly 30 using rugged metal joining processes such as welding or soldering. The swivel bearing assembly 30 provides a rotary attachment thereto the jumping rope 40 allowing the jumping rope 40 to freely rotate with respect thereto the grip assemblies 20 during normal use of the device 10. The swivel bearing assembly 30 is envisioned to comprise a standard corrosion-resistant and sealed ball bearing component further comprising an outer bearing race 31, an inner bearing race 32, and a plurality of internal ball bearings in an expected manner. The inner bearing race 32 comprises an upward extended inner collar portion providing a central bored hole having a suitable diameter so as to snugly receive an end portion of the jumping rope 40 being securely affixed therein preferably using adhesives; however, other durable methods of attachment may be employed such as crimping, a through-pin, or the like, providing equal benefit thereto a user 50.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be provided as indicated in FIG. 1.

The method of and utilizing the device 10 may be achieved by performing the following steps: procuring a particular model of the device 10 which provides a desired jumping rope 40 length and spring 24 resistance; grasping the two (2) grip assemblies 20 such that a user's 50 fingers are in contact therewith the finger relief portions 23 of the finger grips 22; squeezing each thumb 21 and finger 22 grip pair together, thereby enabling the flexing motion 45 of the device 10 and reducing a relative distance therebetween said grips 21, 22, as desired; experiencing a normal rope jumping session in a normal manner; and, enjoying combined benefits of arm strengthening and cardio-vascular workouts afforded a user 50 of the present invention.

It is also understood that one (1) or both of the grip assemblies 20 may be utilized independently of the rope portion 40 while, for example, in a sitting position, in order to focus specifically upon an arm strengthening benefit of the device 10. Conversely, a user 50 may use the device 10 as a simple jumping rope 40 by holding, but not squeezing the grip portions 21, 22 together during a rope jumping activity, thereby primarily receiving a cardiovascular workout.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An exercise device comprising a jump rope with resistance hand grips, comprising:

a jump rope comprising a first end and a second end;

a first hand-grip rotatably connected thereto said first end of said jump rope with a first swivel bearing assembly; and, a second hand-grip rotatably connected thereto said second end of said jump rope with a second swivel bearing assembly;

wherein said jump rope is capable of turning freely as said first hand-grip and said second hand-grip are held stationary when said exercise device is in use;

wherein a user can flex said first hand-grip and said second hand-grip to a closed position while using said exercise device, thereby providing an exercising means thereto said user;

wherein said first hand-grip and said second hand-grip each further comprise:

a thumb grip thereby providing a first gripping means for a thumb of said user; and, a finger grip comprising a first finger relief area, a second finger relief area, a third finger relief area, and a fourth finger relief area, thereby providing a second gripping means for a plurality of fingers of said user;

a spring comprising a first spring end affixed thereinto said finger grip and a second spring end affixed thereinto said thumb grip;

a first hinge connected thereto a respective swivel bearing assembly;

a second hinge connected thereto said respective swivel bearing assembly;

a first connector plate comprising a first connector plate bottom end affixed thereinto said finger grip and a first connector plate top end connected thereto said first hinge;

a second connector plate comprising a second connector plate bottom end affixed thereinto said finger grip and a second connector plate top end connected thereto said second hinge;

a first support link connected thereto said first connector plate and slidingly encircling therearound a first side coiled portion of said spring; and, a second support link connected thereto said second connector plate and slidingly encircling therearound a second side coiled portion of said spring;

a retaining ring comprising an open center region, located adjacent thereto said finger grip and said thumb grip, encompassing said first spring end and said second spring end;

wherein said user can squeeze said finger grip towards said thumb grip thereby providing said exercising means thereto said user;

wherein said first finger relief area, said second finger relief area, said third finger relief area, and said fourth finger relief area are located along an outer edge of said finger grip and provide said user a comfortable gripping surface;

wherein said spring provides a flexible relationship with said finger grip and said thumb grip thereby allowing a flexing motion therebetween said finger grip and said thumb grip when said device is in use;

wherein said retaining ring provides a mechanical limiting means thereto said spring thereby establishing a fixed location of said finger grip and said thumb grip when in a relaxed position;

wherein said first support link and said second support link provide additional strength and stability thereto said first hand-grip and said second hand-grip; and, wherein said first hinge and said second hinge provide a pivoting relative motion therebetween said first connector plate and said second connector plate.

2. The jump rope of claim 1, wherein said thumb grip and said finger grip are made of a hard plastic material.

3. The jump rope of claim 1, wherein said thumb grip and said finger grip each comprise a molded-in knurled pattern thereupon an external surface, thereby providing an enhanced gripping surface.

4. The jump rope of claim 1, wherein said thumb grip and said finger grip each comprise a sprayed-on latex coating thereby providing an enhanced gripping surface.

5. The jump rope of claim 1, wherein said first swivel bearing assembly and said second swivel bearing assembly each further comprise:

an inner bearing race securing a respective end of said jump rope therein by an attachment means; and, an outer bearing race connected thereto said inner bearing race comprising a plurality of internal ball bearings.

6. The jump rope of claim 5, wherein said attachment means comprises one (1) of the following list: an adhesive, a crimping means, or a through-pin.

7. The jump rope of claim 5, wherein said jump rope is approximately six (6) to nine (9) feet long.

8. The jump rope of claim 5, wherein said spring is made of a tempered and plated spring steel.

9. The jump rope of claim 5, wherein said first connector plate and said second connector plate are approximately one-quarter (¼) to one-half (½) inch wide.

10. The jump rope of claim 5, wherein said first support link and said second support link are made of a tempered and plated spring steel.

11. The jump rope of claim 5, wherein said device is available in a variety of different spring resistance levels.

12. A method of using an exercise device comprising a jump rope with resistance hand grips, said method comprising the steps of:

providing said exercise device, comprising:

a jump rope comprising a first end and a second end;

a first hand-grip rotatably connected thereto said first end of said jump rope with a first swivel bearing assembly; and, a second hand-grip rotatably connected thereto said second end of said jump rope with a second swivel bearing assembly;

wherein said jump rope is capable of turning freely as said first hand-grip and said second hand-grip are held stationary when said exercise device is in use;

wherein a user can flex said first hand-grip and said second hand-grip to a closed position while using said exercise device, thereby providing an exercising means thereto said user;

wherein said first hand-grip and said second hand-grip each further comprise:

a thumb grip thereby providing a first gripping means for a thumb of said user; and, a finger grip comprising a first finger relief area, a second finger relief area, a third finger relief area, and a fourth finger relief area, thereby providing a second gripping means for a plurality of fingers of said user;

a spring comprising a first spring end affixed thereinto said finger grip and a second spring end affixed thereinto said thumb grip;

a first hinge connected thereto a respective swivel bearing assembly;

a second hinge connected thereto said respective swivel bearing assembly;

a first connector plate comprising a first connector plate bottom end affixed thereinto said finger grip and a first connector plate top end connected thereto said first hinge;

a second connector plate comprising a second connector plate bottom end affixed thereinto said finger grip and a second connector plate top end connected thereto said second hinge;

a first support link connected thereto said first connector plate and slidingly encircling therearound a first side coiled portion of said spring; and, a second support link connected thereto said second connector plate and slidingly encircling therearound a second side coiled portion of said spring;

a retaining ring comprising an open center region, located adjacent thereto said finger grip and said thumb grip, encompassing said first spring end and said second spring end;

wherein said user can squeeze said finger grip towards said thumb grip thereby providing said exercising means thereto said user;

wherein said first finger relief area, said second finger relief area, said third finger relief area, and said fourth finger relief area are located along an outer edge of said finger grip and provide said user a comfortable gripping surface;

wherein said spring provides a flexible relationship with said finger grip and said thumb grip thereby allowing a flexing motion therebetween said finger grip and said thumb grip when said device is in use;

wherein said retaining ring provides a mechanical limiting means thereto said spring thereby establishing a fixed location of said finger grip and said thumb grip when in a relaxed position;

wherein said first support link and said second support link provide additional strength and stability thereto said first hand-grip and said second hand-grip; and, wherein said first hinge and said second hinge provide a pivoting relative motion therebetween said first connector plate and said second connector plate procuring a particular model of said exercise device which provides a desired jump rope length and a desired spring resistance;

grasping said first hand-grip and said second hand-grip such that said user's fingers are in contact therewith a first finger relief area, a second finger relief area, a third finger relief area, and a fourth finger relief area of a finger grip;

squeezing a thumb grip and said finger grip of each first hand-grip and said second hand-grip theretogether, thereby enabling a flexing motion of said device and reducing a relative distance therebetween said thumb grip and said finger grip, as desired;

experiencing a normal rope jumping session in a normal manner; and, enjoying combined benefits of arm strengthening and cardio-vascular workouts afforded said user of said device.

* * * * *